United States Patent [19]

Shibano

[11] Patent Number: 5,021,012

[45] Date of Patent: Jun. 4, 1991

[54] MULTIPIN CONNECTOR

[75] Inventor: Yasuji Shibano, Lzumisano, Japan

[73] Assignee: Hosiden Electronics Co., Ltd., Osaka, Japan

[21] Appl. No.: 506,833

[22] Filed: Apr. 10, 1990

[30] Foreign Application Priority Data

Apr. 17, 1989 [JP] Japan ..... 64-45269[U]

[51] Int. Cl.[5] ..... H01R 9/03

[52] U.S. Cl. ..... 439/610; 439/752; 439/695; 439/397

[58] Field of Search ..... 439/695, 696, 701, 731, 439/752, 395–407, 607, 609, 610, 660, 744, 746, 747, 748

[56] References Cited

U.S. PATENT DOCUMENTS

| | | | |
|---|---|---|---|
| 2,810,210 | 3/1957 | Komatsu . | |
| 4,225,009 | 3/1981 | Clark | 439/398 |
| 4,277,124 | 7/1981 | Loose et al. | 439/398 |
| 4,327,958 | 5/1982 | Hughes et al. | 439/701 |
| 4,354,719 | 10/1982 | Weidler | 439/398 |
| 4,734,054 | 3/1988 | Steffinger | 439/399 |

FOREIGN PATENT DOCUMENTS

| | | | |
|---|---|---|---|
| 0147218 | 7/1985 | European Pat. Off. . | |
| 1582011 | 12/1980 | United Kingdom . | |
| 2130448 | 5/1984 | United Kingdom . | |
| 2147153 | 5/1985 | United Kingdom . | |
| 216711 | 5/1986 | United Kingdom | 439/701 |

*Primary Examiner*—David L. Pirlot

*Attorney, Agent, or Firm*—Pollock, VandeSande and Priddy

[57] ABSTRACT

A multiple connector has an insulating body which contains a plurality of pin contacts arranged in rows and columns of a matrix. The insulating body is inserted securely in the front end portion of a cylindrical metal shielding body. Front end faces of contact holding plates holding these pin contacts in a row or a column arrangment are held in abutment with the rear face of the insulating body. The contact holding plates respectively have contact holding grooves formed therein to extend in a front and rear direction. Cord connection portions of the pin contacts extending or projecting from the rear face of the insulation body are pressed into and secured to these contact holding grooves. The cord connection portion has a press-in contact portion formed integrally therein and the press-in contact portion has a slot of a width smaller than the diameter of a core bundle of the cord to be connected. When a covered cord is pressed into the slot, the cover is torn and edges of the slot intrude into the core bundle. An engagement piece is formed at the middle portion of the pin contact. When the pin contact is inserted into the contact housing hole, the engagement piece engages with a stepped portion formed on an inner wall of the contact housing hole, so that the contact holding plate and the insulation body are engaged through the pin contact.

7 Claims, 6 Drawing Sheets

MULTIPIN CONNECTOR

BACKGROUND OF THE INVENTION

The present invention relates to a multipole or multipin connector used, for example, to electrically connect various appliances to each other, as well as adapted to carry out a number of functions.

A multipole or multipin connector of such kind is disclosed, for example, in U.S. Pat. No. 4,810,210 issued Mar. 7, 1989.

According to the conventional multipin connector disclosed in said U.S. Patent, the multipin connector is constituted by, as shown in FIG. 1 and FIG. 2 accompanying this application, a tubular shielding member 100 made of metal, a square-shaped body 200 of an insulating material inserted in the front end of the tubular shielding member 100, and a plurality of pin contacts 300 held in the square-shaped body 200 so as to mutually insulated. The multipin connector shown has a cable 400 connected thereto.

It is apparent that the metal shielding member 100 has a connection opening 101 formed at its front end, and a plug (not shown) is inserted into the connection opening 101. Front ends of the pins 301 of the pin contacts 300 are arranged so as to confront the connection opening 101.

According to the characteristic construction or design of the conventional a multipin connector, the shape of the front portion of the insulation body 200 is a square similar to a regular square, from which portion the pins 301 extend and are arranged securely in a matrix of rows and columns.

Because these pins 301 extend from and are arranged in a matrix of rows and columns on the square front portion of the insulation body 200, it is possible to advantageously obtain a multipin connector provided with the connection opening 101 having a relatively narrow or small width W even when the number of the pin contacts 300 is relatively large.

When a connector is made of an oblong shape, such as connectors for print boards or printed circuits, the more the number of poles, the longer or wider the width of the oblong connector, so that the number of poles to be used in the connector is limited.

On the contrary, when the square face of the insulation body 200 is employed and pins 301 extend from and are arranged in a matrix on the square face, it is possible to make the transverse width W of the shielding member 100 narrow and to connect a number of poles in a small available space.

According to the conventional multipin connector described above, each of the cord connection portions 302 of the pin contacts 300 has a pair of a front cord gripper and a rear cord gripper, which respectively have a pair of tongue portions erected from its plate-like side edges extending rearward from the pins 301. In a space between the tongue portions constituting one of the cord grippers, a core bundle 402 of the cord 401 is placed and then the tongue portions are crimped or caulked in order to connect electrically and mechanically the pin contacts 300 and the core bundle 402 of the cord 401 to each other. The other cord gripper grips or holds the insulation covering portion of the cord 401 when the tongue portions of the cord gripper are caulked, so that the cord 401 is mechanically held by the pin contacts 300.

It is noted that, the assembly of the conventional multipin connector disposed in the above mentioned U.S. patent requires the steps of connecting the cord 401 to the pin contacts 300, peeling off the insulation cover of the front end portion of the cord 401, exposing the core bundle 402, crimping two pairs of tongue portions formed on the pin contacts 300 to the exposed portions of the core bundle 402, and inserting the pin contacts 300 to which the cord is connected into contact housing holes 201 of the insulation body 200. The number of these steps is large and these steps are relatively troublesome, so that the assemblying of the conventional multipin connector necessitates many hours.

It is a purpose of the present invention to provide a multiple connector which makes it easier to connect a pin connector to a cord.

It is another purpose to provide a multipin connector having a construction enabling automated assembling of the multipin connector.

SUMMARY OF THE INVENTION

According to the present invention, a multipin connector is provided with a square-shaped insulation body in which a plurality of pin contacts are held and arranged in the insulation body in a matrix of rows and columns, and said insulation body is securely inserted in the front end portion of a cylindrical metal shielding body, a front end face of a contact holding plate in each row or column of a contact housing hole is faced to a rear face of the insulator body, each contact holding plate has contact holding grooves extending longitudinally so as to communicate with each contact housing hole respectively formed in one face of respective contact holding plates, a cord connection portion of the pin contact is pressed in the contact holding groove and held there, each cord connection portion has metal wall portions formed integrally so as to extend along directions perpendicular to the longitudinal direction of the cord connection portion, the metal wall portions respectively have press-in contact portions cut into the portions of a width narrower than the diameter of the core bundle of the cord, and the pin contact has its middle portion provided with an integral engagement piece. As a result when the pin portion of the pin contact is inserted through the contact housing hole of the insulation body, the engagement piece engages with a stepped portion formed on the inner face of the contact housing hole, holding the pin contacts and the contact holding plates to the insulation body.

According to the construction of the preferred embodiment of the present invention, the cord connection portion of the pin contact is pressed into the contact holding groove of the contact holding plate and held there and, by forcing a covered cord into the press-in contact portion of the pin contact the insulation cover of the cord is torn by slot edges of the press-in contact portion, allowing the core bundle of the cord to contact the slot edges. As a result, the cord is electrically connected to the pin contact.

A plurality of pin contacts 300, respectively are held in a plurality of contact holding plates 500 and each pin 301 of the pin contact 300, which projects from the contact holding plate 500, is inserted in the corresponding contact housing hole 201 formed in the insulation body 200. In this condition, the engagement piece 313 formed at the middle of the pin contact 300 engages with the stepped portion formed on the inner wall of the contact housing hole 201, preventing the pin contact from slipping out of position. Then, a plurality of contact holding plates 500 are laid one upon another at the rear portion of the insulation body and held securely in position.

In consequence, according to the present invention, it is not necessary to peel off or remove an insulation cover from the end portion of the cord before connecting the cord with the pin contact 300. That is, simple press-insertion of the cord end portion with an insulation cover into the press-in contact portion surely connects the cord and the pin contact 300.

In addition, because a plurality of pin contacts 300 for one row or one column are installed in the contact holding plate together with the cords held in the pin contacts by caulking and then the contact holding plates are applied to the insulation body, the assembly of the cord or cable 400 and the metal shielding member 100 is carried out without difficulty, attaining an easy and advantageous mass production of the products.

DETAILED DESCRIPTION OF THE PREFERRED EMBODIMENT

Figure 3:
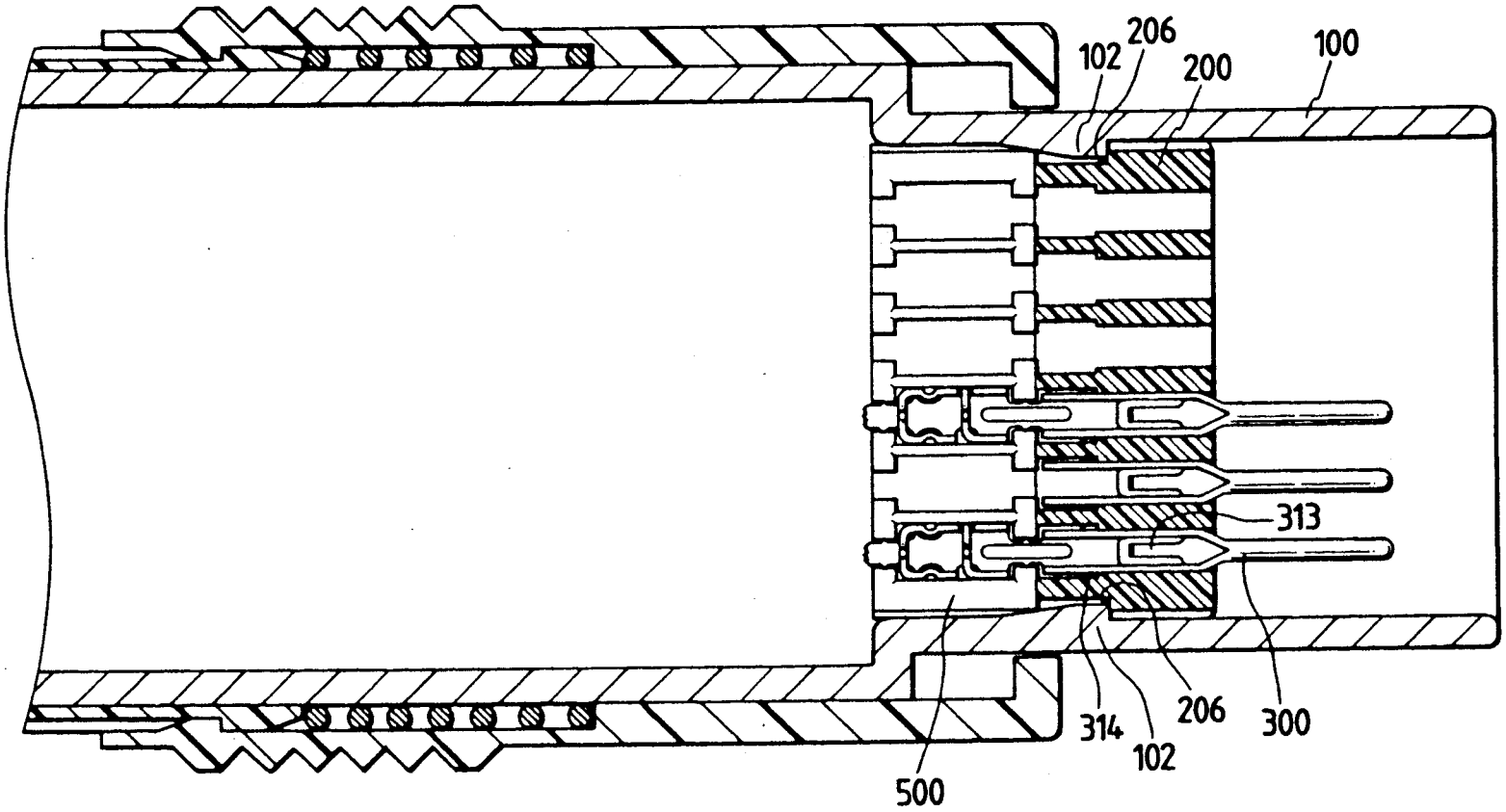
FIG. 3 is a section of the preferred embodiment of the present invention omitting a rear portion of the embodiment.

The preferred embodiment of the multipin connector according to the present invention is shown in FIG. 3. FIG. 3 doesn't show the cable lead-out side portion of the multipin connector and the conventional structure of the cable lead-out side portion of the connector can be applied to the multipin connector according to the present invention. The cylindrical metal shielding body 100 may be of the conventional design, so the characteristic feature of the present invention resides in the holding mechanism of the pin contacts 300 held within the square insulation body 200 fitted in the front portion of the metal shielding body and the connecting mechanism of the pin contacts 300 connected to the cord of the cable 400. Consequently, only the holding mechanism and the connecting mechanism above will be explained using the drawings.

Figure 1:
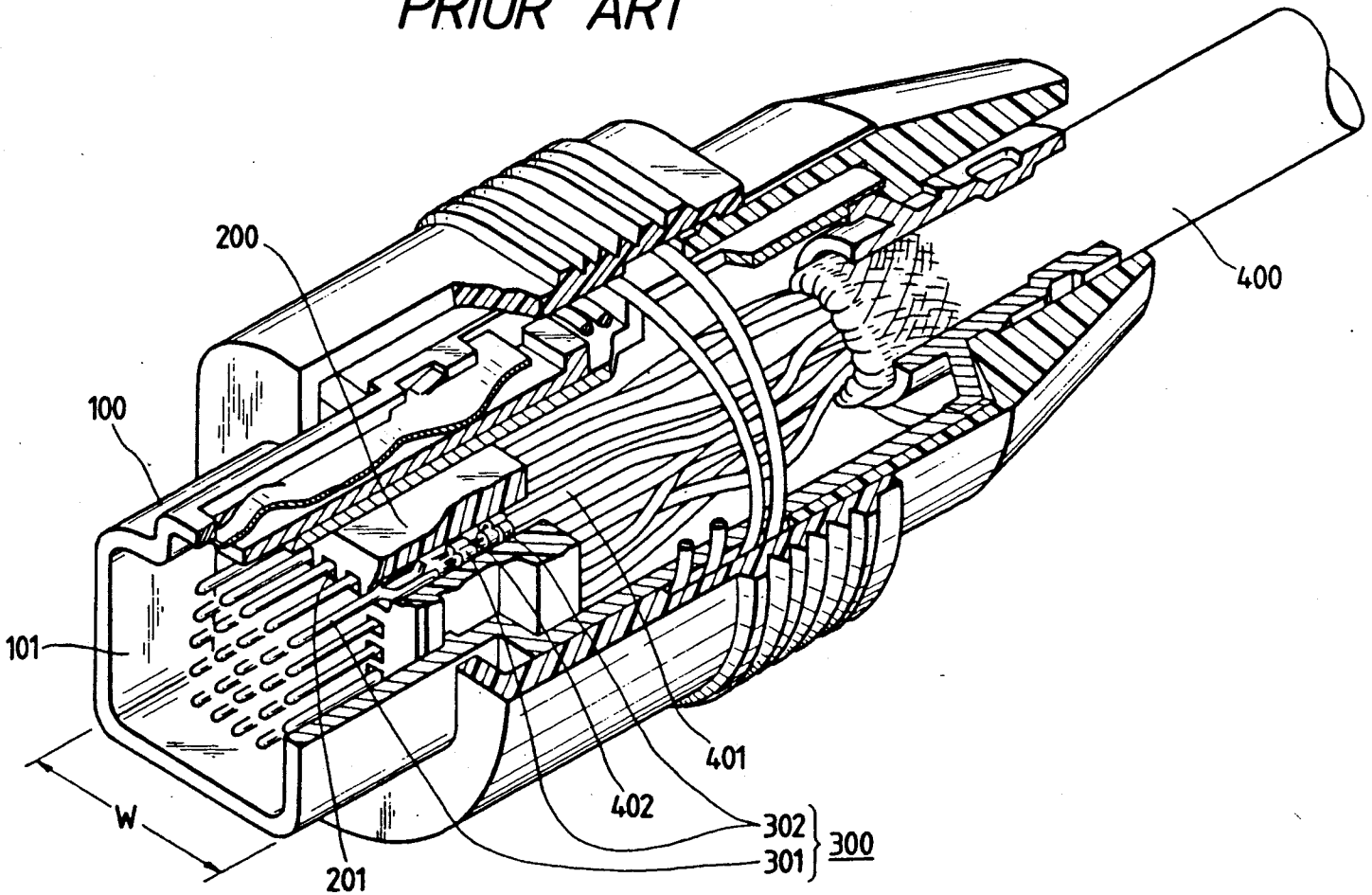
FIG. 1 PRIOR ART
FIG. 1 is a partly broken perspective view showing a conventional multipin connector.
Figure 2:
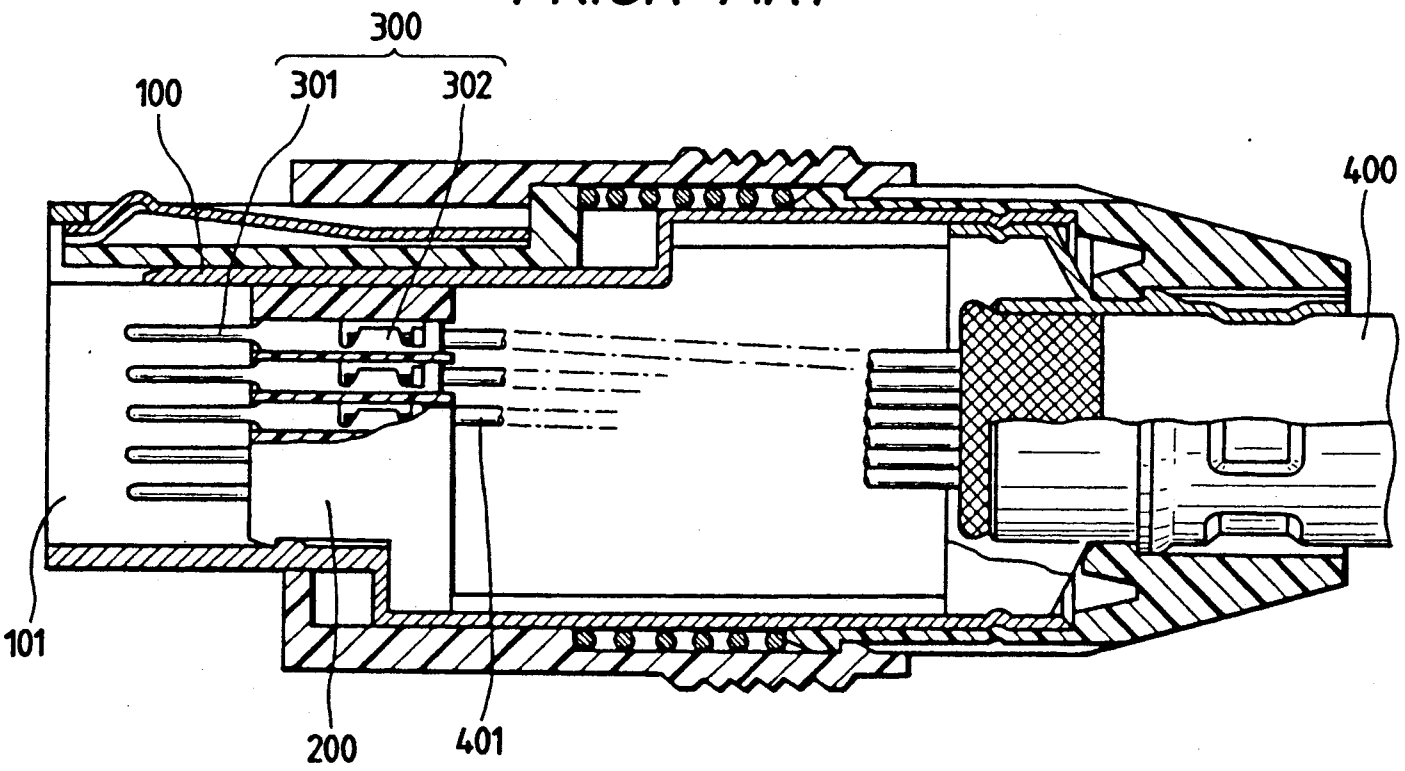
FIG. 2 PRIOR ART
FIG. 2 is a sectional view of the multipin connector shown in FIG. 1.

According to the present invention, the length in the longitudinal direction of the insulation body 200 is shorter than that of the conventional body shown in FIG. 1 and FIG. 2. The cord connection portion of each pin contact 300 extends from the rear face of the insulation body 200. The front end face of the contact holding plate 500, made of an insulating material such as synthetic resin, is so placed as to face the rear face of the insulation body 200.

Figure 4:
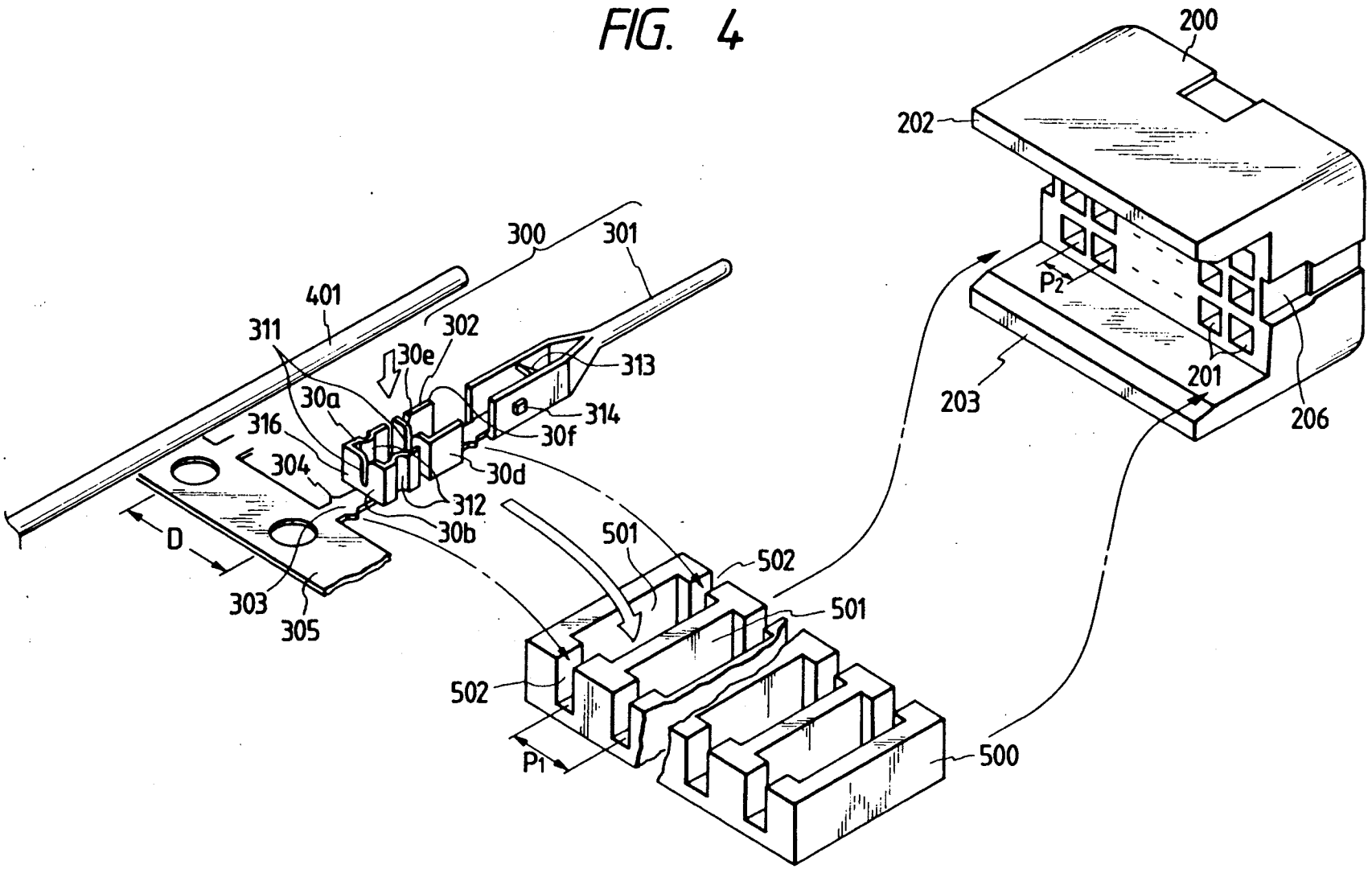
FIG. 4 is a perspective view of a disassembled portion of the preferred embodiment.

As shown in FIG. 4, the contact holding plate 500 has a plurality of contact holding grooves 501 respectively formed in a face of the plate 500. The contact holding grooves 501 extend longitudinally of the multipin connector in parallel to each other. The cord connection portions 302 of the pin contacts 300 are each pressed into the contact holding grooves 501 so as to firmly secure these connection portions 302 in the contact holding grooves 501. According to the compression procedure of the pin contacts 300, a pair of projections 304 formed at both sides of the strip-like base plate portions 303, respectively situated at a front and a rear of the cord connection portion 302 are pressed into narrow portions 502 formed at both ends of the contact holding grooves 501 in order to firmly hold the pin contacts 300 in the contact holding plate 500. In the particular embodiment shown of the present invention, an arrangement pitch $P_1$, i.e., the distance between the contact holding grooves 501 is identical with an arrangement pitch $P_2$ along a column direction of the matrix of the contact housing holes 201 formed in the insulation body 200 as seen in FIG. 4.

According to the preferred embodiment, the rear end of the base plate portion 303 constituting the pin contact 300 is connected perpendicular to the strip-like hoop 305. By selecting or determining a distance D between the two pin contacts 300 connected to the hoop 305 so that it is identical with the arrangement pitch $P_1$ of the contact holding grooves 501 formed in the contact holding plate 500, it becomes possible to simultaneously insert the plurality of the cord connection portions 302 of the pin contacts 300 while these pin contacts 300 are connected to the hoop 305. After that, projections 304 formed at both sides of the base plate portion 303 are pressed into the narrow portion 502, so that the plurality of pin contacts 300 can be simultaneously fixed to the contact holding plate 500.

Carry out an insertion operation of the plurality of pin contacts 300 into the contact holding grooves 501 while these pin contacts are connected to each other through the hoop 305 as shown makes the operation easy. Also, it is possible to easily automate the insertion operation in which automation the plural pin contacts 300 are the same time secured to the contact holding plate 500. Just after the pin contacts 300 are pressed into the contact holding plate 500, the hoop 305 is separated from the pin contacts 300 by cutting at the base plate portions 303.

Figure 5:
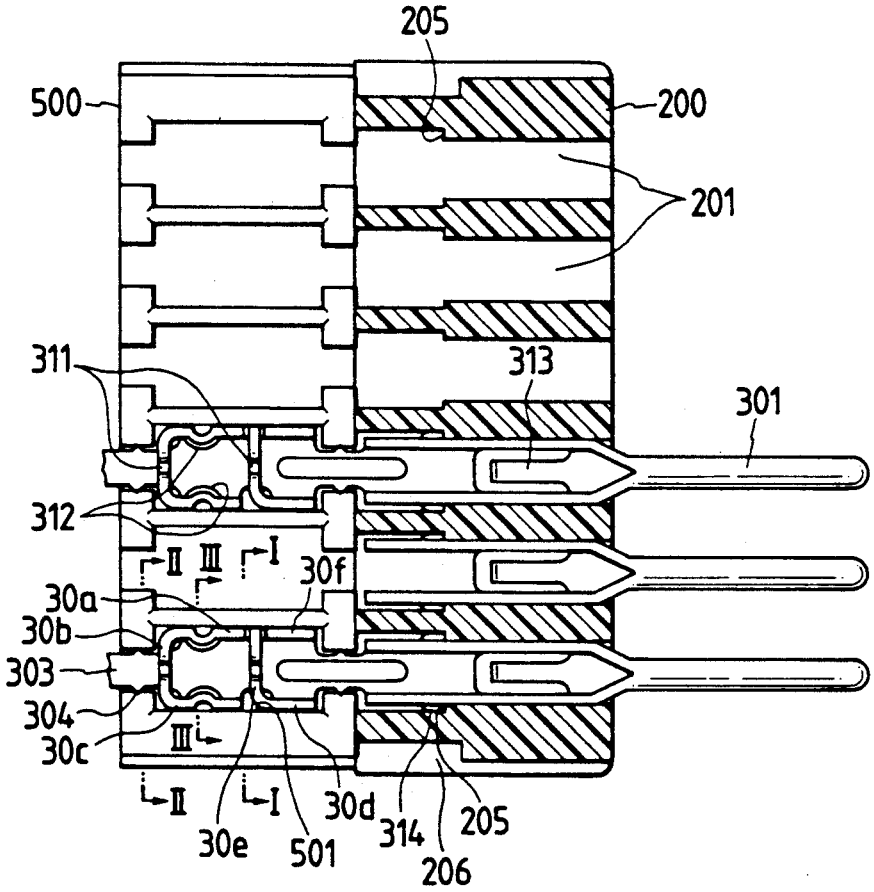
FIG. 5 is a horizontal section showing a contact holding plate connected to the insulation body.

According to the preferred embodiment shown, the cord connection portion 302 of the pin contacts 300 has two press-in contact portions 311 formed therein, as shown in FIG. 4 and FIG. 5, spaced from each other along the longitudinal direction. These press-in contact portions 311 may be formed by erecting conductive plates 316 perpendicularly to the longitudinal direction from the base plate portion 303 of the pin contact 300, the plates 316 having formed therein slots of a width narrower than the diameter of the core bundle of the cord 401 to be employed so as to extend perpendicularly to the plane of the base plate portion 303. By pressing the cord 410 having an insulation cover into the slots, the insulation cover is torn, resulting in an intrusion of the slot edges of the conductive plate 316 into the core bundle of the cord 501, thus achieving effective connection between the pin contact 300 and the cord.

According to the preferred embodiment, the covered portion of the cord 401 is gripped in the slots situated and formed at two positions of the press-in contact portions 311 and the cord portion is mechanically fixed to the pin contact 300 by a clamp portion 312. The clamp portion 212 is made by pressing or striking inwardly two portions or parts of the pin contacts 300 to restrict or narrow the insertion passage of the cord 401. When the cord 401 is pressed into the narrowed or clamp portion 312, the cord 401 is strongly held in the pin contact 300.

Figure 6:
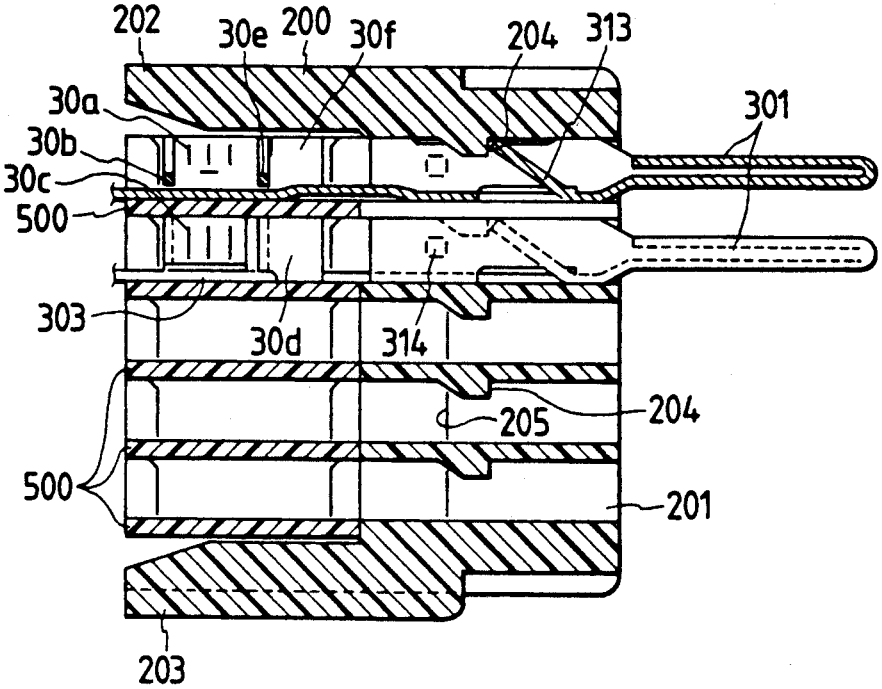
FIG. 6 is a vertical section depicting the contact holding plate connected to the insulation body.

The press-in contact portion 311 and the clamp portion 312 are made of a sheet of metal plate integral with the pin contact 300 by pressing the metal sheet. In the preferred embodiment as shown in FIG. 4–FIG. 6, a side plate 30*a* is integrally formed by erecting or bending perpendicularly a part of the base plate portion 303 at a side thereof, and a rear end of the side plate 30*a* is bent at a right angle in order to obtain the conductive plate 30*b* erected on the base plate portion 303 at a right angle thereto. Furthermore, the end portions of the conductive plate 30*b* opposing the side plate 30*a* are bend forward at a right angle, making a pair of side plates 30*c*. The conductive plate 30*b* has a slot formed therein at the middle of the top edge thereof so as to extend toward the base plate portion 303, thereby formed the press-in contact portion 311. At the middle portions along the fore and rear direction of the side plates 30*a* and 30*c*, there are projections extending perpendicularly and projecting inwardly in order to construct the clamp portion 312. Parts of the side edges of the base plate portion 303 adjacent and in front of the front end of the side plate 30*c* are bent at a right angle so as to form side plate 30*d* in a side by side relation with the side plate 30*c*. The rear end portions of the side plate 30*d* are bent at a right angle in order to erect the conductive plate 30*e* on the base plate portion 303 perpendicularly to the base plate portion.

The conductive plate 30*e* also has a slot formed therein at the middle of the upper edge thereof to extend toward the base plate portion 303, forming another press-in contact portion 311. In front of the side plate 30*a*, a side plate 30*f* is erected integrally on the base plate portion 303 in a side by side relation to the side plate 30*a*. The free end portion of the conductive plate 30*e* is sandwiched and held between the front end of the side plate 30*a* and the rear end of the other side plate 30*f*. The rightmost section of the cord connection portion 302 shown in the uppermost row in FIG. 7 correspond to that taken along a I—I line, the second from the right is a section taken along a II—II line, and the third from the right is a section taken along a III—III line, respectively in FIG. 5. As shown in FIG. 5, the groove width of the contact holding groove 501 is determined so as to be a little larger than the distances of the side plates 30*a* and 30*c* and side plates 30*d* and 30*f*.

The number of the contact holding plates 500 to be prepared is determined so as to be identical with the number of the rows or the columns of the matrix of the contact housing holes 201 formed in the insulation body 200 and each contact holding plate 500 holds pin contacts 300 of a number identical with that of the pin contacts arranged in a row or a column. In the preferred embodiment shown, the contact holding plates 500 of a number identical with that of one row of the matrix of the contact housing holes 201 are employed. It is preferable to make or fabricate these contact holding plates 500 from synthetic resin of various different colors. That is, each cord of a multicore cable in general is identified by a color, so that it is possible to decrease the rate of erroneous wiring or connection of the cables by making the color of a particular cord and of the corresponding contact holding plate 500 identical to each other.

Figure 7:
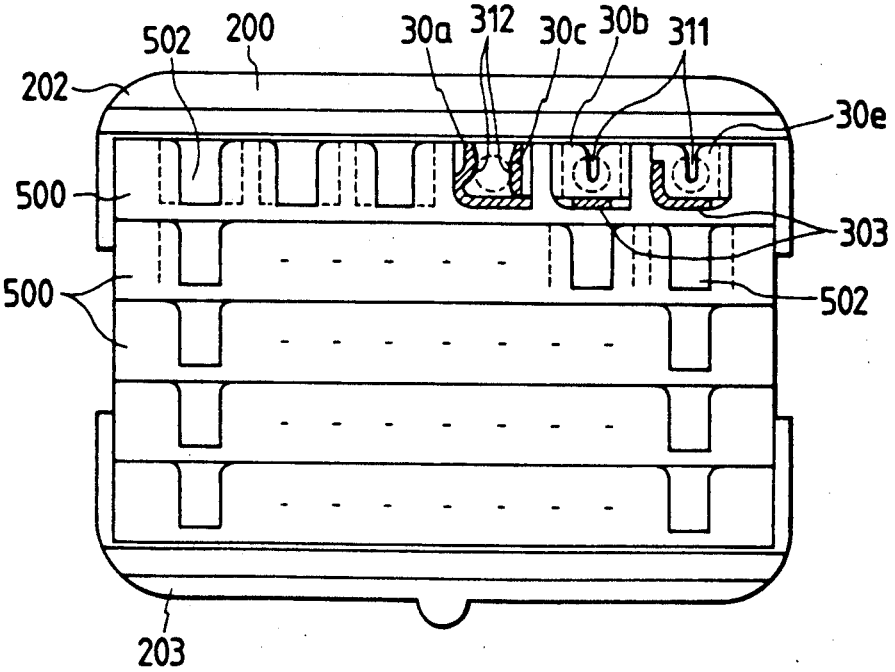
FIG. 7 is a left side view of the assembly of the contact holding plate and the insulation body.

It is apparent from FIG. 4 that the insulation body 200 has an upper projection 202 and a lower projection 203 integrally formed at the upper end and bottom end of the rear face of the insulation body 200 so as to face each other. In a space between these projections 202 and 203, a set of contact holding plates 500 laid one upon another is inserted as shown in FIGS. 6 and 7. When the contact holding plates 500 of the number identical with that of the row of the contact housing holes 201 are laid one upon another, the total thickness of the assembled contact holding plates 500 is made substantially identical with the gap between projections 202 and 203 and the contact holding plates 500 are inserted and held between these projections 202 and 203. In FIGS. 5–7, in only a few of the contact holding grooves 501, the pin contacts 300 are held. It is apparent that practically in all contact holding grooves 501 corresponding pin contacts 300 are held.

When inserting the contact holding plates 500 between the projections 202 and 203, the pins 301 of the pin contacts 300 projecting from the contact holding plate 500 are inserted into the corresponding contact housing holes 201 formed in the insulation body 200.

As shown in FIG. 4 and FIG. 6, the engagement piece 313 is formed in the middle space of each pin contact 300 by raising a part of the pin contact. As shown in FIG. 4 and FIG. 5, a pair of projections 314 protrude from the side faces of the pin contact 300. It is apparent from FIGS. 5 and 6 that the engagement pieces 313 and the projections 314, respectively are engaged with stepped portions 204 and 205 formed on the inner walls of the contact housing holes 201, and in consequence the pin contacts 300 are prevented from coming out of the insulation body 200. Thus, assembly of the pin contact 300 and the insulation body 200 has been completed.

After that, as shown in FIG. 3, the insulation body 200 is pressed into the front end of the metal shielding body 100 and dents 206 (FIGS. 4 and 5) formed on both sides of the insulation body 200 are engaged with the projections 102 formed on an inner wall of the metal shielding body 100, whereby the insulation body 200 is firmly fixed in the space inside of the shielding body 100, completing the assembling operation.

In the above description one contact holding plate 500 is provided for each row of the matrix of the contact housing holes 201; however, it is possible to provide the contact holding plate 500 for each column of the matrix. In addition, it is possible to form contact holding grooves 501 on both sides of the contact holding plate 500 in order to apply the pin contacts 300 to respective sides of the contact holding plate 500.

As explained above, according to the present invention, cords 401 can be electrically connected to the pin contacts 300 without peeling off the insulation covers of the cords 401.

Because the cord 401 can be pressed in and connected to the pin contacts 300 while the pin contacts are held in the contact holding plate 500 at a unit of a single row or column of the pin contacts, the connection of the cord to the multipin connector according to the present invention can be easily automated.

In addition, because the pin contacts 300 are held or secured to the hoop 305 at an interval D identical with the arrangement pitch $P_1$ of the contact holding grooves 501 formed in the contact holding plates 500 while the pin contacts 300 are being manufactured, it is possible to make the contact holding grooves 501 of the contact holding plates 500 matched at the same time to the plurality of pin contacts 300 and then the pin contacts 300 are pressed into the contact holding grooves 501. As a result, this part of the assembly operation of the cord and the multipin connector can also be automated.

Because the plural pin contacts 300 held in the contact holding plate 500 can be assembled simultaneously to the insulation body 200 of the multipin connector of the present invention, all pin contacts 300 can be installed in the insulation body 200 in a time shorter than when all pin contacts 300 are assembled one by one in the insulation body 200.

Where the colors of individual contact holding plates 500 are made different from one another and a particular color of each contact holding plate 500 is made identical with that of the insulation cover of the corresponding cords 401, erroneous connection between the cords 401 and the corresponding contact holding plate 500 is not like to occur, and it is possible to attain easy assembling of the cords and the contact holding plates 500.

What is claimed is:

1. A multipin connector comprising:

a square-shaped insulation body having a plurality of contact housing holes extending along a front and rear direction through said insulation body, said contact housing holes being arranged in rows and columns, a plurality of pin contacts provided with front portions of pins projecting forward from said insulation body and rear portions of cord connection portions projecting rearward from said insulation body, said pin contacts being inserted through each contact housing hole formed in the insulation body, a cylindrical metal shielding body having a front portion into which said insulation body is inserted and secured thereto and a rear portion provided with a cable lead-out opening, contact holding plates each of which is provided for a corresponding one of said rows or columns of contact housing holes, each said contact holding plate being made of an insulating material and having contact holding grooves formed on a face of the contact holding plate to extend in a front and rear direction to face said contact housing holes, said cord connection portions of said pin contacts in each row or column being pressed into and secured to the contact holding grooves of a corresponding one of said contact holding plates, press-in contact portions formed integrally with the cord connection portions, said press-in contact portions having conductive plates each of which extends substantially perpendicularly to the front and rear direction of the cord connection portion and has a slot of a width smaller than the diameter of a core bundle of a cord, so that a covered cord is pressed into the slot, tearing the cover to make the core bundle in contact with edges of the slot, and engagement pieces provided at middle portions of said pin contacts so as to engage with stepped portions formed on the inner walls of said contact housing holes, whereby when the pin contacts are inserted to the contact housing holes, said pin contacts and the contact holding plates are firmly held in the insulation body.

2. The multipin connector according to claim 1, wherein the thickness of said contact holding plate is determined so as to be identical substantially with the arrangement pitch of said contact housing holes and the insulation body has a pair of projections projected from the rear face of the insulation body, which projections are formed so as to sandwich two ends of assembled contact holding plates, these ends being situated along the assembling direction of the contact holding plates.

3. The multipin connector according to claim 1, wherein the cord connection portions of the pin contacts have strip-like base portions provided with projections at two sides of a part of the base portion, said part is situated at a front end and a rear end of said cord connection portion, and said projections are pressed and secured to front and rear end projections of the contact holding groove.

4. The multipin connector according to claim 3, wherein the portions of the contact holding groove into which the projections are pressed-in are made narrow.

5. The multipin connector according to claim 1, wherein the cord connection portion of the pin contact has strip-like base portions, a part of the one side of the base plate portion is bent at a right angle so as to form a side plate extending in a front and rear direction, an end of the part of the side of the base plate portion is further bent at a right angle so as to form a conductive plate erected on the base plate portion perpendicular to the base plate portion, and a slot is formed in the conductive plate to extend toward said base plate portion in order to form the press-in contact portion.

6. The multipin connector according to claim 5, wherein a plurality of press-in contact portions consisting of a side plate integral with said base plate portion and said conductive plate are arranged longitudinally.

7. The multipin connector according to claim 5, wherein another side plate confronting said side plate is formed integrally from the other side of the base plate portion, and mutual confronting parts of these sides plates are pressed inwardly mutually in order to form a clamp portion, so that the clamp portion holds the cord to be connected.

* * * * *